US011035129B2

(12) United States Patent
Maccari

(10) Patent No.: US 11,035,129 B2
(45) Date of Patent: Jun. 15, 2021

(54) ASSESSABLE CERAMIC SLAB-SHAPED ELEMENT

(71) Applicant: Antonio Maccari, Pisa (IT)

(72) Inventor: Antonio Maccari, Pisa (IT)

( * ) Notice: Subject to any disclaimer, the term of this patent is extended or adjusted under 35 U.S.C. 154(b) by 0 days.

(21) Appl. No.: 16/380,576

(22) Filed: Apr. 10, 2019

(65) Prior Publication Data

US 2019/0316362 A1 Oct. 17, 2019

(30) Foreign Application Priority Data

Apr. 13, 2018 (IT) ..... 202018000002362

(51) Int. Cl.
*B32B 3/00* (2006.01)
*E04F 13/14* (2006.01)
*E04F 15/08* (2006.01)

(52) U.S. Cl.
CPC ..... *E04F 13/14* (2013.01); *E04F 15/08* (2013.01)

(58) Field of Classification Search
CPC ..... E04F 13/14; E04F 15/08
See application file for complete search history.

(56) References Cited

U.S. PATENT DOCUMENTS

| | | | | |
|---|---|---|---|---|
| 9,367,772 | B2 * | 6/2016 | Maccari | G06K 15/027 |
| 2014/0192373 | A1 | 7/2014 | Maccari | |
| 2017/0197448 | A1 * | 7/2017 | Velner | H04N 1/6036 |
| 2019/0225849 | A1 * | 7/2019 | Bollstrom | C04B 41/009 |

FOREIGN PATENT DOCUMENTS

| | | | |
|---|---|---|---|
| IT | MO2011A000229 | | 3/2013 |
| WO | WO 03//031370 | * | 4/2003 |

* cited by examiner

*Primary Examiner* — Elizabeth E Mulvaney
(74) *Attorney, Agent, or Firm* — Pearne & Gordon LLP

(57) ABSTRACT

A slab-shaped ceramic element comprises a first face which has at least a decorated zone and a second face intended to be laid in contact with a support surface. The first face is opposite the second face. The decorated zone is delimited by a plurality of edges. The first face has a plurality of control coloured areas arranged in sequence along at least one edge delimiting the decorated zone.

11 Claims, 1 Drawing Sheet

ASSESSABLE CERAMIC SLAB-SHAPED ELEMENT

This invention relates to a slab-shaped ceramic element, i.e. a ceramic tile shaped as a slab, in particular of large dimensions.

In the ceramic field, the size of the tiles has been progressively increased in recent times, in particular as far as ceramic tiles made of porcelain stoneware are concerned. In the 1980s, ceramic tiles had, in the majority of cases, a square conformation with dimensions of 30 cm×30 cm. Subsequently, standard formats of 40 cm×40 cm or of 45 cm×45 cm have been developed, up to reaching the current most used format, which is 60 cm×60 cm.

However there is also a significant presence of formats of up to 75 cm×75 cm and 80 cm×80 cm, and also slabs having dimensions of 120 cm×120 cm, for use as floorings, or having even larger dimensions, to be used as wall coverings.

This occurs because in today's world there is a taste for surfaces on which tiles or ceramic slabs are applied that are practically without joints, i.e. separation lines between two adjacent tiles. For this reason, the market has recently included rectangular ceramic slabs having dimensions of 100 cm×300 cm or even of 160 cm×320 cm.

Large dimension ceramic slabs, for example having dimensions of the above-cited type, imply various difficulties, different to those implied by small format ceramic tiles, especially as regards handling and transport. In particular, large-dimension ceramic slabs cannot be manually moved, nor manually lifted.

This makes it very difficult, if not impossible, to subject the large-dimension ceramic slabs to control operations, in particular for the purpose of establishing whether the decoration applied on a preset ceramic slab satisfactorily corresponds to the decoration applied on a sample (or master) ceramic slab, i.e. control operations aimed at carrying out a control of the tone of a ceramic slab.

These operations are in fact usually carried out by manually lifting a ceramic tile to be examined and arranging it on an appropriate support in a substantially vertical position, next to a sample ceramic tile, so that the tile to be examined can be visually compared with the sample tile.

In the case of large-dimension ceramic slabs, carrying out the above-mentioned control operations is extremely complicated, as it is not easy—and in some cases not even possible—to manually lift the ceramic slab to be examined in order to arrange it, in a substantially vertical position, next to the sample ceramic slab. This makes it extremely difficult to carry out a visual comparison between the ceramic slab to be examined and the sample ceramic slab.

If, furthermore, with the purpose of carrying out precise assessments, it is decided to print a calibration target on ceramic slabs of relevant dimensions of the above-mentioned type, it is difficult to measure the calibration target, which is an operation needed to define the model or profile that any colour management system requires. This is because, owing to the dimensions of the slab, it is not simple to correctly position, with respect to the slab, a spectral scanner which enables measuring the calibration target, nor is it simple to produce a relative movement between the spectral scanner and the slab.

An object of the invention is to enable the quality of the decoration printed on a slab-shaped ceramic element to be controlled in a simple way, in particular when the slab-shaped ceramic element is an element having large dimensions.

A further object is to facilitate the acquiring and measurement of a calibration target printed on a slab-shaped ceramic element, especially a slab-shaped ceramic element having large dimensions.

According to the invention, there is provided a slab-shaped ceramic element, comprising a first face having a decorated zone and a second face intended to be laid in contact with a support surface, the first face being opposite the second face, the decorated zone being delimited by a plurality of edges, wherein the first face has a plurality of control coloured areas arranged in sequence along at east one edge of said plurality of edges.

The control coloured areas are usable for indirectly controlling the decorated zone printed on the first face of the slab-shaped ceramic element. In fact, by analysing the control coloured areas it is possible to establish whether the process of ceramic printing used for printing the decorated zone on the first face is able to give rise to decorations matching the decoration that it is desired to reproduce, i.e. to slab-shaped ceramic elements matching a master.

For example, the control coloured areas can be printed with known quantities of ink. By spectrally measuring the control coloured areas printed on the slab-shaped ceramic element it is possible to calculate what relationship exists between quantity of ink and perceived colour. By knowing the quantity of the inks used to create the decoration on the first face, the relationship between the quantity of ink and the perceived colour, as calculated above, enables a determination of the perceived colour for the decorated zone in its entirety, so that the decorated zone can be numerically compared with a sample decoration that it is desired to reproduce.

The control coloured areas are intended to be eliminated after having been used for the control of the decorated zone. This can take place by cutting a slim strip of the slab-shaped ceramic element, along the side of the slab-shaped ceramic element near which the control coloured areas are located. This operation leads to no complications with respect to the traditional production process of slab-shaped ceramic elements, especially having large dimensions.

It is in fact already known to cut and eliminate slim strips of ceramic material near the edges of the slab-shaped ceramic elements, for the purpose of matching up the dimensions of the slab-shaped ceramic elements and eliminating irregular edges. For this purpose, in production lines in which slab-shaped ceramic elements are produced, there are already one or more cutting stations.

The control coloured areas can be printed at the position of the strips that are in any case intended to be eliminated, so as not to cause additional waste of ceramic material and so as not to require additional cutting operations.

Furthermore, by providing the control coloured areas along at least one edge of the decorated zone located on the first face of the slab-shaped ceramic element, the control coloured areas can easily be measured, for example by using a spectral sensor, arranged in a production line along which the slab-shaped ceramic elements advance, in a position at which the edge at issue will transit.

This is particularly useful in a case in which the control coloured areas define at least a part of a calibration target, intended to be measured in order to be subsequently processed.

The invention can be better understood and carried out with reference to the appended drawings, which illustrate some non-limiting example embodiments, and in which:

FIG. 1 shows a slab-shaped ceramic element 10, in particular shaped as a ceramic tile, for example made of porcelain stoneware, conformed as a slab having large dimensions. The slab can have, in plan view, at least a linear dimension that is greater than or equal to 120 cm, but the content of the following description can also be applied to ceramic slabs having smaller dimensions.

Figure 1:
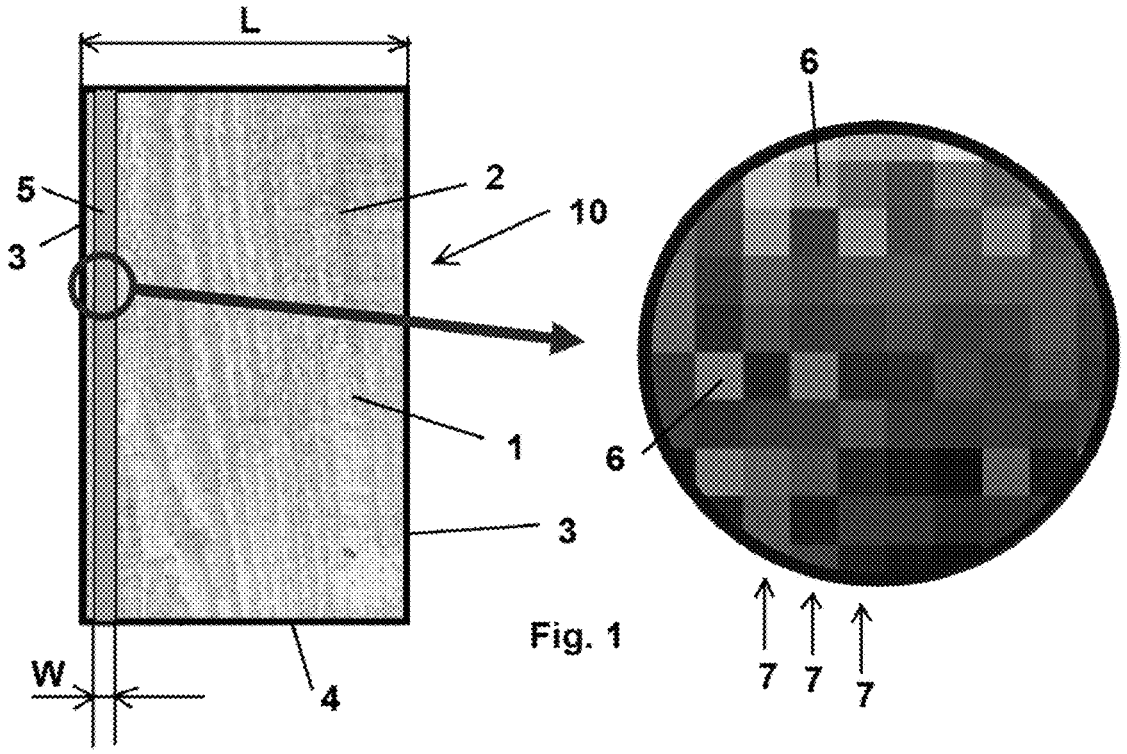
FIG. 1 is a schematic plan view of a slab-shaped ceramic element.

The slab-shaped ceramic element 10 can have a rectangular plan shape, as in the example of FIG. 1, or square, or can be of another type.

The slab-shaped ceramic element 10 has, in plan view, a first face 1, on which a decorated zone or decoration 2 is provided. The decoration 2 can be obtained by ink-jet printing or other technologies. The first face 1 is intended to remain visible, after the slab-shaped ceramic element 10 has been installed on a floor or to form a ceramic covering. The decoration 2 is delimited by a plurality of edges, in particular four edges, which in the illustrated example can comprise two larger edges 3, parallel to one another, and two smaller edges 4, also parallel to one another. Each smaller edge 4 is interposed between two larger edges 3 and can be perpendicular to the larger edges 3.

In the illustrated example, the decoration 2 covers the whole first face 1, so that the edges of the decoration 2 coincide with the edges of the first face 1.

The slab-shaped ceramic element 10 further has a second face, opposite the first face 1 and not illustrated in FIG. 1, intended—during installation—to be rested on a support surface, for example a floor or a wall to be covered.

A control strip 5 is provided near a larger edge 3, the control strip 5 being intended to contain information which enables analysing the behaviour of the production process by means of which the slab-shaped ceramic element 10 can be produced and decorated. The control strip 5 is arranged parallel to the larger edge 3 along which it is provided, and can extend from one smaller edge 4 up to the other smaller edge 4.

As shown in the larger-scale view in the right part of FIG. 1, the control strip 5 comprises a plurality of control coloured areas 6 which can also be termed "patches", each of which has been printed with one or more ceramic inks in known quantities. Each control coloured area 6 has, in the illustrated example, a square shape, but other geometries are also possible. Each control coloured area 6 can have sides of dimensions indicatively comprised between 3 and 6 mm.

The control coloured areas 6 are arranged in sequence along an edge, in particular a larger edge 3, of the decoration 2, so as to form at least a row comprising a plurality of control coloured areas 6 and extending parallel to the larger edge 3. In the illustrated example, the control coloured areas 6 are arranged along a plurality of rows 7, each of which extends parallel to the larger edge 3.

The control coloured areas 6 can define, as a whole, at least a part of a calibration target. The latter can be entirely printed on a single slab-shaped ceramic element 10, or can be printed on a plurality of slab-shaped ceramic elements 10. In this latter case, each slab-shaped ceramic element 10 carries a part of the calibration target, which can be reconstructed, in its entirety, by combining the control coloured areas 6 of several slab-shaped ceramic elements 10.

In a case where a calibration target is printed on a plurality of slab-shaped ceramic elements 10, the slab-shaped ceramic elements 10 defining a single calibration target have control strips 5 that are different to one another.

The control coloured areas 6 are printed on the slab-shaped ceramic element 10 simultaneously with the decoration present on the first face 1, and using the same printing device that produces the decoration.

The slab-shaped ceramic element 10 is then subjected to a firing process inside a kiln, and exits from the kiln advancing in an advancement direction that can be parallel to the larger edges 3.

Downstream of the kiln, a spectral scanning device can be provided, the spectral scanning device being positioned near the larger edge 3 along which the control strip 5 is printed. While the slab-shaped ceramic element 10 advances below the spectral scanning device, the device acquires or measures the control coloured areas 6 of the control strip 5, obtaining a series of data that will then be processed in a known way so as to acquire information on the decoration, in particular to determine which colour will be perceived by an observer in the various points of the decoration. This enables verifying whether the decoration is in accordance with a sample decoration, i.e. whether the decoration reproduces the appearance of the sample decoration with sufficient closeness.

After the control coloured areas 6 have been acquired, the slab-shaped ceramic element 10 can be cut to remove therefrom a band of ceramic material corresponding to the control strip 5. The control strip 5 can thus be separated from the slab-shaped ceramic element 10, in particular from the portion of the slab-shaped ceramic element 10 on which the decoration is present, and be eliminated.

The cut that enables removing the control strip 5 can be carried out in the production line of the slab-shaped ceramic elements 10, downstream of the spectral acquisition device, in a cutting station positioned along the aforesaid production line.

Alternatively, it is also possible to remove the control strip 5 in a subsequent step, for example at the outlet of a warehouse in which the slab-shaped ceramic elements 10 have been stocked for a certain period of time.

The cutting operations which enable removing the control strip 5 have not been specifically thought for the purpose of removing the control strip 5, but have been already carried out on traditional production lines in which printing the control coloured areas 6 was not provided. In this case too, in fact, a slim strip was cut from the edges of the slab-shaped ceramic elements 10, with the purpose of eliminating any irregularities along the edges of the slab-shaped ceramic elements 10 and to match up the dimensions of different slab-shaped ceramic elements 10.

The cutting operations traditionally carried out on the slab-shaped ceramic elements 10 thus enable removing the control strip 5 without additional interventions. The removal of the control strip 5 therefore does not imply complications with respect to the traditional production processes of slab-shaped ceramic elements.

The control strip 5 has rather limited transversal dimensions. For example, in the case of a slab-shaped ceramic element 10 having a width L of 150 mm, the control strip 5 can have a transversal dimension W in the range of 1-6 cm. This enables removal of the control strip 5 without cutting away excessive quantities of ceramic material, thus limiting the waste of ceramic material.

Figure 2:
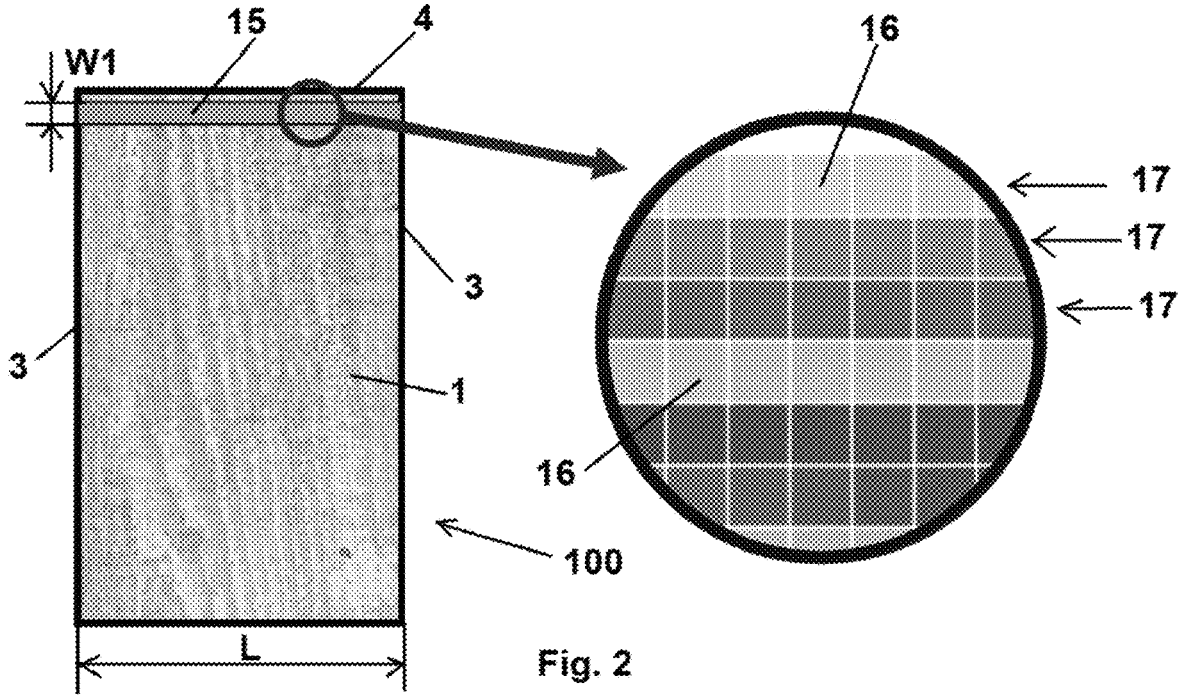
FIG. 2 is a view like FIG. 1, showing a slab-shaped ceramic element according to an alternative embodiment.

FIG. 2 illustrates a slab-shaped ceramic element 100 according to an alternative embodiment, having a first face 1 on which a control strip 15 is printed, the control strip 15 comprising a plurality of control coloured areas 16.

The control strip 15 is arranged near a smaller edge 4 of the slab-shaped ceramic element 100, and can extend from a larger edge 3 to another larger edge 3.

As shown in the larger-scale detail in the right part of FIG. 2, the control strip 15 can comprise a plurality of control rows 17, each of which extends parallel to the smaller edge 4 along which the control strip 15 is arranged. Each control row 17 can comprise a plurality of control coloured areas 16, printed with a known quantity of the same ink. In other words, the control coloured areas 16 that define a control row 17 are printed with the same ink.

The control row 17 in this case enable verification of the print uniformity of the printing devices arranged for printing the decoration on the slab-shaped ceramic element 10. In particular, the control lines 17 enable ascertaining whether the nozzles of an ink-jet printer which prints the decoration on the first face 1 are working in a uniform manner or not.

In the case where a slab-shaped ceramic element has a width L of 150 cm, the control strip 15 can have a transversal dimension W1 in the range of 1-6 cm.

In an embodiment that is not illustrated, the control strips 5 and 15 shown respectively in FIGS. 1 and 2 can be simultaneously present on a single slab-shaped ceramic element.

In this case, the control coloured areas 6 that define the calibration target are printed in sequence, possibly on a plurality of rows, near an edge of the slab-shaped ceramic element which, during printing, is arranged transversally with respect to a bar of the ink-jet printer which supports a plurality of heads. In the illustrated example, this edge coincides with a larger edge 3 of the decoration 2 and also of the slab-shaped ceramic element.

The control coloured areas 16 which enable control of print uniformity are instead printed in sequence, on a plurality of rows, along an edge of the decoration 2, i.e. of the slab-shaped ceramic element which, during printing, is arranged parallel to the bar of the printer which supports the ink-jet heads. In the illustrated example, this edge coincides with a smaller edge 4 of the decoration, i.e. of the slab-shaped ceramic element.

The control coloured areas 6 which define the calibration target and the control coloured areas 16 which enable control of the print uniformity can be obtained and conformed as described in the patent originated from Italian patent application MO2011A000229.

In an alternative embodiment that is not illustrated, the slab-shaped ceramic element can be configured to give rise, after a cutting operation, to two or more ceramic slabs to be laid. In this case, the control coloured areas can be arranged in a central zone of the slab-shaped ceramic element, in a position corresponding to the edges of respective decorated zones of the ceramic slabs which will be obtained by cutting the slab-shaped ceramic element. The edges of the slab-shaped ceramic element are not in this case completely coincident with the edges of the decorated zones of the ceramic slabs which will derive from the slab-shaped ceramic element.

To summarise, the sequence of control coloured areas provided along an edge of the decorated zone enables exploitation of a band of ceramic material, intended in any case to be rejected, in order to print information relative to the production process used, this information being inferred from the control coloured areas. With this information, it is possible to assess the decoration present on the slab-shaped ceramic element without having to visually compare the decoration with a sample.

The invention claimed is:

1. A slab-shaped ceramic element, comprising a first face which has at least a decorated zone and a second face intended to be laid in contact with a support surface, the first face being opposite the second face, the decorated zone being delimited by a plurality of edges, wherein the first face has a plurality of control coloured areas arranged in sequence along at least one edge of said plurality of edges, the control coloured areas being arranged along a plurality of rows which extend parallel to said at least one edge and defining at least a portion of a profiling calibration target.

2. A slab-shaped ceramic element according to claim 1, wherein said plurality of rows forms a control strip having a transversal dimension in the range of 1-6 cm.

3. A slab-shaped ceramic element according to claim 1, wherein the edge along which the control coloured areas are arranged in sequence is a larger edge delimiting the decorated zone.

4. A slab-shaped ceramic element according to claim 1, comprising two control strips arranged along respective adjacent edges of the first face, each control strip comprising a plurality of control coloured areas arranged in sequence along the corresponding edge.

5. A slab-shaped ceramic element according to claim 1, wherein each control coloured area is shaped as a square having a side of dimensions comprised in the range of 3-6 mm.

6. A slab-shaped ceramic element according to claim 1, wherein the first face is delimited by a plurality of edges which coincide with the edges of the decorated zone.

7. A group of at least two slab-shaped ceramic elements according to claim 1, wherein the control coloured areas of one of the slab-shaped ceramic elements of the group are different from the control coloured areas of the other slab-shaped ceramic element of the group, so as to define respective portions of a calibration target printed on a plurality of slab-shaped ceramic elements.

8. A method comprising the steps of:

providing a slab-shaped ceramic element having a first face and a second face, the second face being intended to be laid in contact with a support surface, the first face being opposite the second face, printing a decorated zone and a plurality of control coloured areas on the first face, the decorated zone being delimited by a plurality of edges, the control coloured areas being arranged in sequence along at least one edge of said plurality of edges and being arranged along a plurality of rows which extend parallel to said at least one edge and define at least a portion of a calibration target, firing in a kiln the slab-shaped ceramic element having the decorated zone and the plurality of control coloured areas printed thereon;

downstream of the kiln, measuring the control coloured areas by means of a spectral scanning device to determine whether the decorated zone is in accordance with a sample decoration, thereby assessing the decorated zone present on the slab-shaped ceramic element without having to visually compare the decorated zone with the sample decoration.

9. A method according to claim 8, wherein the control coloured areas are printed with known quantities of inks and wherein, after the step of measuring, the following steps are provided:

for each control coloured area, calculating a relationship between quantity of inks and measured colour, from the quantity of inks used to print each control coloured area and from said relationship, determining a perceived colour for the decorated zone in its entirety;

numerically comparing the perceived colour for the decorated zone in its entirety with the sample decoration.

10. A method according to claim 8, wherein, after the step of measuring, there is provided the step of cutting a strip of the slab-shaped ceramic element along which the control coloured areas are located and eliminating said strip.

11. A method according to claim 8, wherein the calibration target is defined by different sets of control coloured areas printed on consecutive slab-shaped ceramic elements, each slab-shaped ceramic element of said consecutive slab-shaped ceramic elements carrying a part of the calibration target, the method further comprising the step of reconstructing the calibration target by combining the sets of control coloured areas of the consecutive slab-shaped ceramic elements.

* * * * *